US007014546B1

(12) United States Patent
Birk

(10) Patent No.: US 7,014,546 B1
(45) Date of Patent: Mar. 21, 2006

(54) EXTENDABLE REMOTE MOTORED SANDER AND METHOD THEREFOR

(76) Inventor: John Birk, 15509 N. 36th St., Phoenix, AZ (US) 85032

( * ) Notice: Subject to any disclaimer, the term of this patent is extended or adjusted under 35 U.S.C. 154(b) by 29 days.

(21) Appl. No.: 10/975,574

(22) Filed: Oct. 28, 2004

(51) Int. Cl.
*B24B 23/00* (2006.01)

(52) U.S. Cl. ..... 451/355; 451/354

(58) Field of Classification Search ..... 451/350–359, 451/360, 361
See application file for complete search history.

(56) References Cited

U.S. PATENT DOCUMENTS 2,483,720 A * 10/1949 Asbury ..... 451/355
3,648,413 A * 3/1972 Godwin et al. ..... 451/358
3,656,920 A * 4/1972 Helms ..... 451/358
4,118,897 A * 10/1978 Martin ..... 451/355
4,317,282 A * 3/1982 Pace ..... 30/122
4,782,632 A * 11/1988 Matechuk ..... 451/354

* cited by examiner

*Primary Examiner*—Dung Van Nguyen
(74) *Attorney, Agent, or Firm*—Jeffrey D. Moy; Harry M. Weiss; Weiss, Moy & Harris, P.C.

(57) ABSTRACT

A remote powered extendable sander has a sanding unit having a sanding surface. A drive system is coupled to the sanding unit. The drive system is used to move the sanding surface. A drive transfer unit is provided for transferring rotational motion from a small motorized construction tool to the drive system for powering the sanding unit. A housing is coupled to the sanding unit. An extension member is removably coupled to the housing for raising the remote powered extendable sander.

18 Claims, 2 Drawing Sheets

EXTENDABLE REMOTE MOTORED SANDER AND METHOD THEREFOR

BACKGROUND OF THE INVENTION

1. Field of the Invention

This invention relates generally to construction tools, and more specifically, to an extendable sander which is able to reach high places such as ceiling and which is remotely powered by a standard power tool device thereby lighten the weight of the extendable sander so that a person can more easily use the sander.

2. Description of the Prior Art

Presently, when sanding high out of reach areas such as a ceiling or the like, one has to use stilts or erect scaffolding. Sanding of a ceiling is generally necessary during construction due to the use of joint compound, sometimes called mud, used to cover nail heads driven into drywall and to cover tape which applied to drywall joints. Sanding is generally done by using a hand sander or a powered drywall sander. Sanding by hand is a tedious and time consuming endeavor which requires a person to expend a lot of energy by manually moving the sander. Because of this, many people use power sanders. However, power sanders are heavier than hand sanders and are difficult to hold above one's head for extend periods of time.

Whether one uses a hand sander of a power sander in order to sand ceilings or other high areas, one still has to use stilts or erect scaffolding. The use of stilts or scaffolding have a lot of different safety concerns. Thus, it would be more practical, safe, and convenient to be able to use a power sander which could reach high areas while one is situated on the ground.

It is known to use a power sander fitted to an extension pole or handle to reach the ceiling of a building. However, it has been found that due to the weight of the rotary power sander, use of the extension becomes tiresome and difficult over extended periods of use. Furthermore, prolonged use of a power sander fitted to an extension handle may result in serious injuries to the shoulders and the back of a user.

Therefore, a need existed to provide an improved sander. The improved sander must overcome the problems associated with prior art sanders. The improved sander must be extendable to reach high places such as ceilings. The improved sander must further be lightweight so that the sander is not unwieldy to use at a distance.

SUMMARY OF THE INVENTION

In accordance with one embodiment of the present invention, it is an object of the present invention to provide an improved sander.

It is another object of the present invention to provide an improved sander that overcome the problems associated with prior art sanders.

It is still another object of the present invention to provide an improved sander that is extendable in order to reach high places such as ceilings.

It is still another object of the present invention to provide an improved sander that is lightweight so that the sander is not unwieldy to use at a distance.

BRIEF DESCRIPTION OF THE EMBODIMENTS

In accordance with one embodiment of the present invention, a remote powered extendable sander is disclosed. The remote powered extendable sander has a sanding unit. The sanding unit has a belt plate. A pair of rollers are provided wherein a first roller is placed on a front side of the belt plate and a second roller is placed on a rear side of the belt plate. A sandpaper belt is placed around the pair of rollers and a bottom surface of the belt plate so the bottom surface of the belt plate forms a sanding surface for the sanding unit. A drive system is coupled to at least one of the pair of rollers. The drive system is used to rotate the pair of rollers to move the sandpaper belt. A drive unit is used for powering the sanding unit. The drive unit is a small motorized construction tool. The drive unit being located away from the sanding unit and removably coupled to an individual using the remote powered extendable sander. A drive transfer unit is coupled to the drive system for transferring rotational motion from the drive unit to the drive system for powering the sanding unit. A housing is coupled to the sanding unit. An extension member is removably coupled to the housing for raising the remote powered extendable sander.

In accordance with another embodiment of the present invention, a remote powered extendable sander is disclosed. The remote powered extendable sander has a sanding unit having a sanding surface. A drive system is coupled to the sanding unit. The drive system is used to move the sanding surface. A drive transfer unit is provided for transferring rotational motion from a small motorized construction tool to the drive system for powering the sanding unit. A housing is coupled to the sanding unit. An extension member is removably coupled to the housing for raising the remote powered extendable sander.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings.

DETAILED DESCRIPTION OF THE PREFERRED EMBODIMENT

Figure 1:
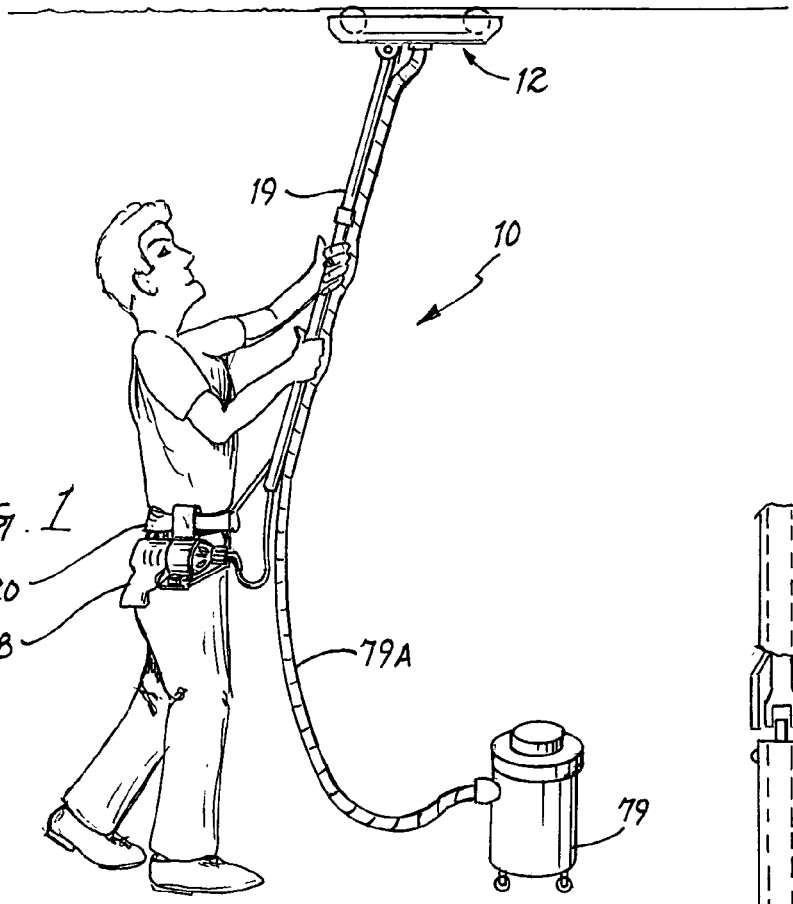
FIG. 1 is a perspective view of the remote powered extendable sander of the present invention in use.

Referring now to the Figures, wherein like numerals and symbols represent like elements, a remote powered extendable sander 10 (hereinafter sander 10) is shown. The sander 10 is designed to be extendable so that the sander 10 can reach high areas such as a ceiling and the like. The sander 10 is also remotely powered. The power source for driving the sander 10 is not on the main unit of the sander 10. This reduces the weight of the sander 10 so that the sander 10 is not unwieldy to use at a distance.

The sander 10 has a main sanding unit 12, extension member 14, and drive transfer unit 16. The drive transfer unit 16 is generally coupled to a drive unit 18. The drive unit 18 is generally a standard motorized construction tool such as a cordless drill or the like. The construction tool could also be a standard electric drill. The construction tool will generally be held in a holster 20, such as a tool belt, around the waist of the user. This will significantly lighten the weight of the sander 10 thereby reducing fatigue and increasing the production of the worker.

As stated above, the sander 10 has a main sanding unit 12. The main sanding unit 12 has a sander 22. The sander 22 can be a rotating sander or a belt sander. In the embodiment depicted in the Figures, a belt sander is shown. However, this should not be seen as to limit the scope of the present invention.

The sander 22 has a rotational surface 24. The rotational surface can be a rotating plate member for a rotating sander or a rotating belt system for a belt sander. In the Figures, the rotating surface 24 has a pair of rollers 26. A belt plate 28 is positioned between the rollers 26 so that a bottom surface of the belt plate 28 is approximately level with the bottom surface of the rollers 26. A sandpaper belt 30 is placed around the rollers 26 and the bottom surface of the belt plate 28 so that the bottom surface of the belt plate 28 forms a sanding surface for the sander 22.

An adjustment mechanism 32 is coupled to at least one of the rollers 26. The adjustment mechanism 32 is used to loosen or tighten the tension of the sandpaper belt 30 around the rollers 26. This is done by slightly moving the position of the roller 26 coupled to the adjustment mechanism 32. By moving the rollers 26 closer together, one can remove and replace the sandpaper belt 30. Once a new sandpaper belt 30 is positioned around the rollers 26, one can use the adjustment mechanism 32 to move the rollers 26 farther apart. This tightens and holds the sandpaper belt 30 around the rollers 26.

A housing 34 is coupled to the sander 22. The housing 34 is generally a lightweight housing. The housing 34 can be made out of a lightweight but sturdy material such as plastic, aluminum, or the like. The housing 34 generally has a top section 36. The top section 36 will have a pair of sidewalls 38 which extend downward from the top section 36. A front wall 40 and a rear wall 42 extend down and away from the top section 36. The housing 34 is generally coupled to the sander 22 so that the housing 34 is positioned on the opposite side of the rollers 26 from the belt plate 28.

Figure 5:
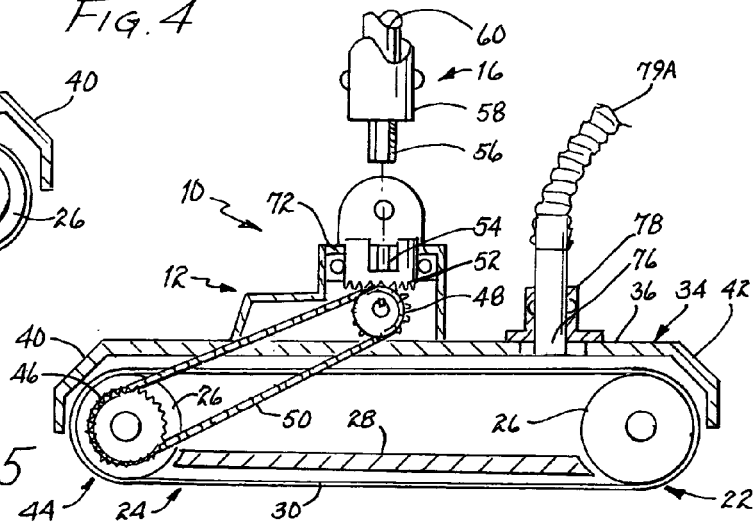
FIG. 5 is a side view of the sanding unit of the remote powered extendable sander of the present invention.

A drive system 44 is coupled to at least one of the rollers 26. The drive system 44 is used to rotate the roller 26 in order to move the sandpaper belt 30. The drive system 44 is generally comprised of a plurality of gears. Referring to FIG. 5, one embodiment of the drive system 44 is shown. In this embodiment, the drive system 44 has a first driving gear 46 coupled to one of the rollers 26. A second driving gear 48 is coupled to the first driving gear 46 via a drive belt 50. A third driving gear 52 is directly coupled to the second driving gear 48 and to the drive transfer unit 16. In operation, the drive transfer unit 16 will rotate the third driving gear 52. This in turn will rotate the second driving gear 48 since the second and third driving gears 48 and 52 are coupled together. The rotation of the second driving gear 48 will rotate the first driving gear 46 since both the first and second driving gears 46 and 48 are coupled together via the drive belt 50. The rotation of the first driving gear 46 will rotate the roller 26 thus rotating the sandpaper belt 30.

Figure 6:
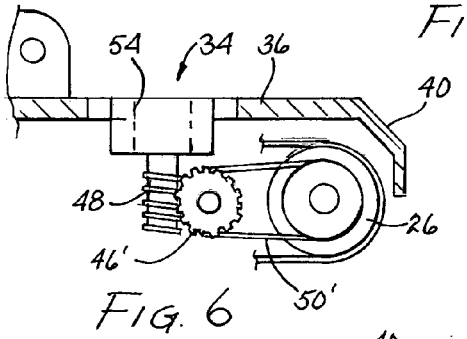
FIG. 6 is a close-up view of the gearing used to drive the remote powered extendable sander of the present invention.

Referring to FIG. 6, a second embodiment of the drive system 44 is shown. In this embodiment, the driving system 44 has a first driving gear 46'. The first driving gear 46' is coupled to one of the rollers 26 via a drive belt 50'. A second driving gear 48' is directly coupled to the drive transfer unit 16 and to the first driving gear 46'. In operation, the drive transfer unit 16 will rotate the second driving gear 48'. This in turn will rotate the first driving gear 46' since the first and second driving gears 46' and 48' are coupled together. The rotation of the first driving gear 46' will rotate the roller 26 since the first driving gear 46 is coupled to the roller 26 via the drive belt 50.

A drive socket 54 s generally formed in the drive system 44. In the embodiment depicted in FIG. 5, the drive socket 54 is formed in a top section of the third driving gear 52. In the embodiment depicted in FIG. 6, the drive socket 54 is formed in a top section of the second gear 48'.

The drive transfer unit 16 is coupled to the drive socket 54 in order to rotate the drive system 44. The drive transfer unit 16 is comprised of a drive block 56. The drive block 56 is of approximately the same size and shape of the drive socket 54. The drive block 56 will slide into the drive socket 54 in order for the drive transfer unit 16 to move the drive system 44. The drive block 56 generally has a lock collar 58. The lock collar 58 will securely hold the drive block 56 within the drive socket 54 in order for the drive transfer unit 16 to move the drive system 44.

Figure 2:
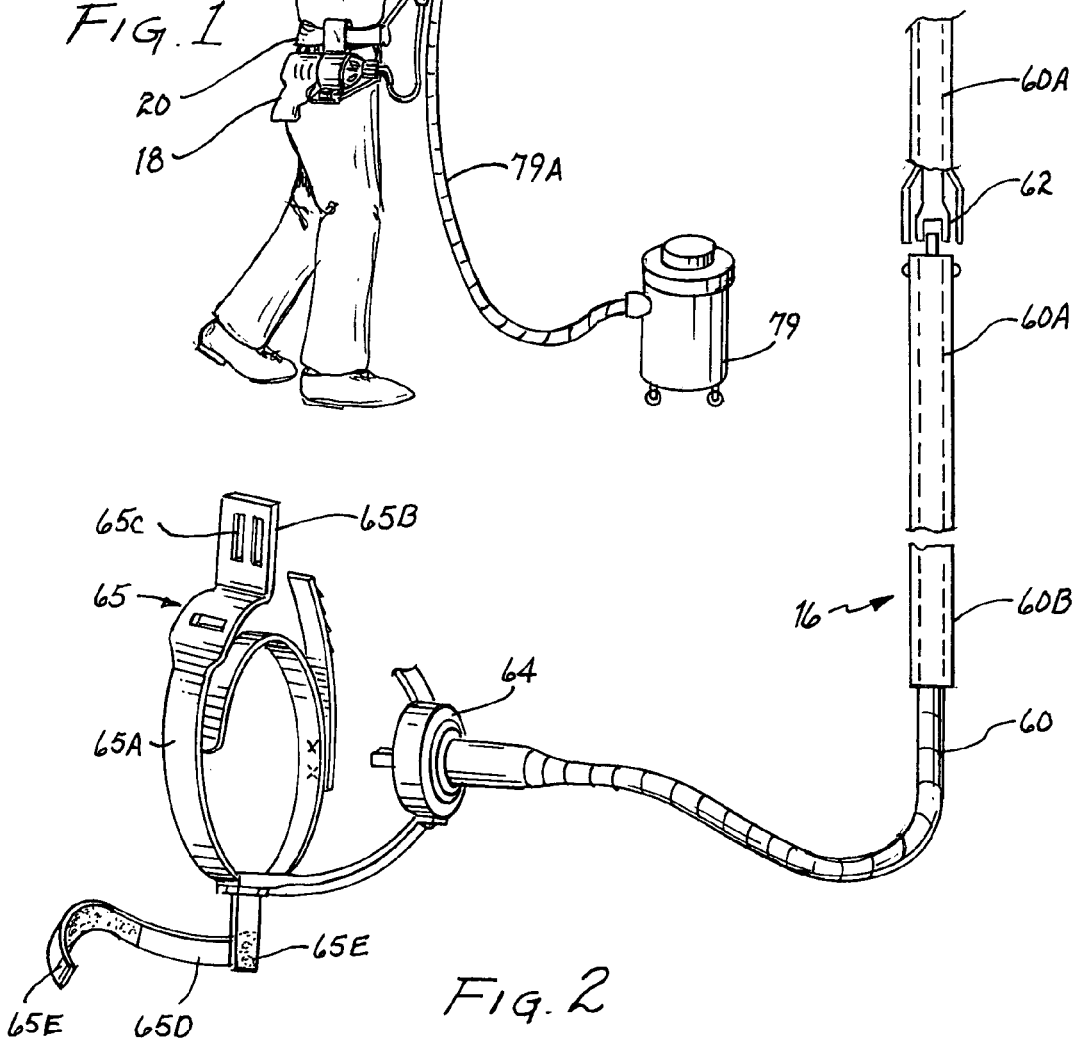
FIG. 2 is a close-up view of the drive mechanism used in the remote powered extendable sander of the present invention.
Figure 3:
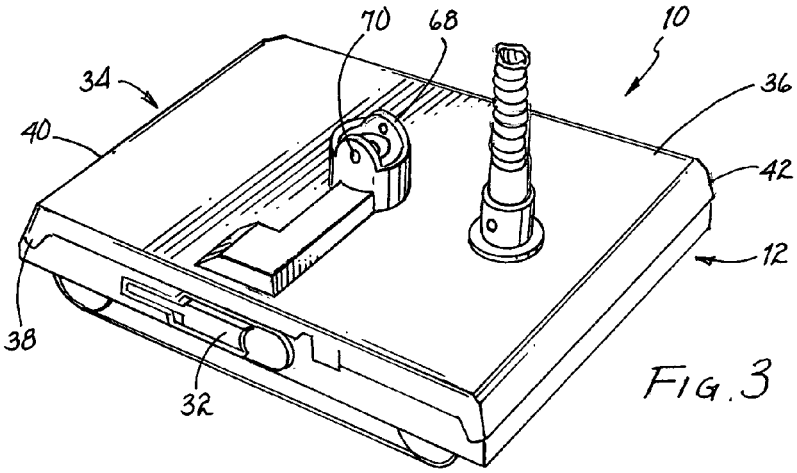
FIG. 3 is a elevated perspective view of the sanding unit of the remote powered extendable sander of the present invention.
Figure 4:
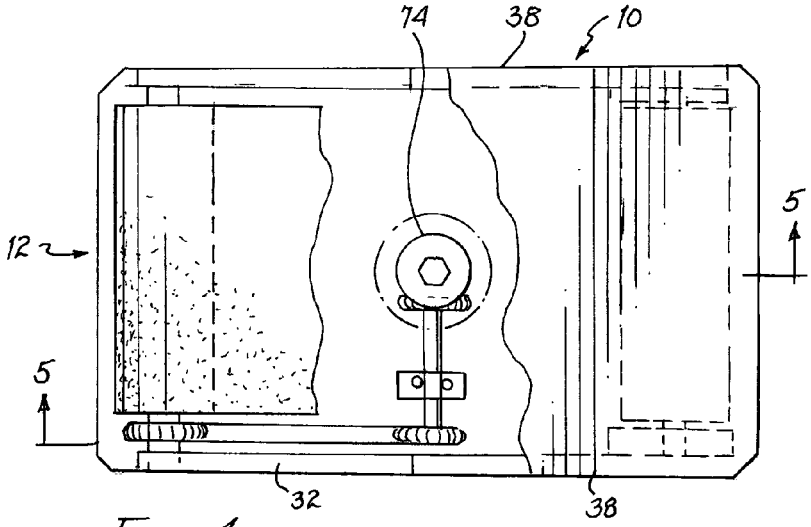
FIG. 4 is a bottom view of the sanding unit of the remote powered extendable sander of the present invention.

A drive cable 60 is directly coupled to the drive block 56. The drive cable 60 is used to transfer the rotation movement from the drive unit 18 to the drive system 44. The drive cable 60 may be a single length cable or may come in a plurality of sections 60A. If the drive cable 60 comes in a plurality of sections 60A, each section 60A will have interlocking members 62 to couple consecutive sections 60A together. The interlocking members 62 may be any type of locking mechanism. In the embodiment depicted in FIG. 2, the interlocking members 62 are a male/female connectors having interlocking tab members. The drive cable 60 is generally covered by a housing conduit 60B. The housing conduit 60B is used to protect the drive cable 60 form damage. The housing conduit 60B is further used to prevent individuals from contact with the drive cable 60 during operation.

On the end of the drive cable 60 opposite of the drive block 56 is a bearing housing 64. The bearing housing 64 aids in the rotating of the drive cable 60 by lessening the friction between the drive cable 60 and the drive unit 18. A second drive block 66 is coupled to the bearing housing 64. The second drive block 66 is coupled to the drive unit 18 for powering the sander A tool belt attachment device 65 is coupled to the end of the drive transfer unit 16 nearest the bearing housing 64. The tool belt attachment device 65 is used to hold and secure the drive unit 18 to the tool belt 20 of the user. The tool belt attachment device 65 will have a collar latch 65A. The collar latch 65A is used to secure the drive unit 18 to the tool belt attachment device 65. The collar latch 65A will have a tab member 65B which extends up from the collar latch 65A. The tab member 65B will have one or more belt slots 65C. The belt slots 65C are used to secure the tool belt attachment device 65 to the tool belt 20. This is done by placing te tool belt 20 through each belt slot 65C.

A strap member 65D is coupled to a bottom section of the collar latch 65A. The strap member 65D is to be used as a trigger lock to hold a switch of the drive unit 18 in an ON position. The strap member 65D will generally have an attachment device 65E to secure both ends of the strap member together thereby holding the switch of the drive unit 18 in the ON position. The attachment device 65E may be hook and loop material, male/female snaps, or the like. The listing of the above should not be seen as to limit the scope of the present invention.

The sander 10 will further have extension member 14. The extension member 14 is generally a light weight pole which will allow one to lift the sander 10 in order to reach high places like a ceiling. The extension member 14 can further be used to house the drive cable 60 and the housing conduit 60B. The extension member 14 is generally made out of a light weight but sturdy material such as, plastic, carbon fiber, aluminum, or the like. The listing of the above should not be seen as to limit the scope of the present invention. The extension member 14 may be a single member pole, a retractable pole, a pole having one or more interlocking sections, or the like.

The extension member 14 is removably coupled to the housing 34. The housing 34 will have a socket fitting 68 formed on a top surface thereof. The socket fitting 68 will have a locking mechanism 70 to securely fasten the extension member 14 to the housing 34. Since the extension member 14 will house the drive cable 60 and the housing conduit 60B, the socket fitting 68 is formed so that there is a passageway 72. The passageway 72 is coupled to an opening 74 formed in the housing 34. The passageway 72 will allow for the drive block 56 to be coupled to the drive socket 54 for powering the sander 10.

A second opening 76 may also be formed in the housing 34. The second opening 76 is coupled to a vacuum socket 78. The vacuum socket 78 will allow one to attach a vacuum hose 79A and thus a vacuum 79 to the housing 34. Thus, when one is sanding an area such as a ceiling, the housing 34 will collect any debris which is sanded off. The vacuum 79 can then collect the debris via the vacuum hose 79A which is coupled to the housing 34.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A remote powered extendable sander comprising:
a sanding unit comprising:
a belt plate;
a pair of rollers wherein a first roller is placed on a front side and a second roller is placed on a rear side of the belt plate; and
a sandpaper belt placed around the pair of rollers and a bottom surface of the belt plate so the bottom surface of the belt plate forms a sanding surface for the sanding unit;
a drive system coupled to at least one of the pair of rollers, the drive system used to rotate the pair of rollers to move the sandpaper belt;
a drive unit for powering the sanding unit, wherein the drive unit is a small motorized construction tool, the drive unit being located away from the sanding unit and removably coupled to an individual using the remote powered extendable sander;
a drive transfer unit coupled to the drive system for transferring rotational motion from the drive unit to the drive system for powering the sanding unit;
a housing coupled to the sanding unit;
an extension member removably coupled to the housing for raising the remote powered extendable sander; and
an attachment device for coupling the drive unit away from the sanding unit and to the individual using the remote powered extendable sander.

2. A remote powered extendable sander in accordance with claim 1 further comprising a vacuum socket coupled to a vacuum opening formed in the housing for coupling a vacuum hose to the remote powered extendable sander.

3. A remote powered extendable sander in accordance with claim 1 wherein the drive system comprises:
a first gear coupled to the first roller;
a second gear rotationally coupled to the housing and coupled to the first gear via a drive belt; and
a third gear rotationally coupled to the housing and directly coupled to the second gear for rotating the second gear, the third gear having a drive socket formed in a top surface thereof for coupling the third gear to the drive transfer unit.

4. A remote powered extendable sander in accordance with claim 1 wherein the drive system comprises:
a first gear rotationally coupled to the housing and coupled to the first roller via a drive belt; and
a second gear rotationally coupled to the housing and directly coupled to the first gear, the second gear having a drive socket formed in a top surface thereof for coupling the second gear to the drive transfer unit.

5. A remote powered extendable sander in accordance with claim 1 wherein the drive transfer unit comprises:
a drive cable for transfers the rotation movement from the drive unit to the drive system;
a first drive block formed on one end of the drive cable for coupling the drive cable to the drive system; and
a second drive block formed on a second end of the drive cable for coupling the drive cable to the drive unit.

6. A remote powered extendable sander in accordance with claim 5 wherein the drive transfer unit further comprises a bearing unit coupled to the second drive block for lessening the friction between the drive cable and the drive unit.

7. A remote powered extendable sander in accordance with claim 5 wherein the drive transfer unit further comprises cable housing for covering the drive cable.

8. A remote powered extendable sander in accordance with claim 5 wherein the drive cable is formed of a plurality of sections each section having interlocking tabs for coupling consecutive sections togther.

9. A remote powered extendable sander in accordance with claim 1 wherein the tool belt attachment device comprises:
a collar latch for holding the drive unit to the tool belt attachment device; and
a tab member extending up from the collar latch wherein the tab member at least one belt slot for securing the tool belt attachment device to a tool belt.

10. A remote powered extendable sander in accordance with claim 9 wherein the tool belt attachment device further comprises:
a strap member coupled to a bottom section of the collar latch, wherein the strap member is used as a trigger lock to hold a switch of the drive unit in an ON position; and
an attachment device coupled to each end of the strap member to secure both ends of the strap member together.

11. A remote powered extendable sander in accordance with claim 9 wherein the drive transfer unit comprises:
a drive cable for transfers the rotation movement from the drive unit to the drive system;

a first drive block formed on one end of the drive cable for coupling the drive cable to the drive system;

a second drive block formed on a second end of the drive cable for coupling the drive cable to the drive unit;

a bearing unit coupled to the second drive block for lessening the friction between the drive cable and the drive unit;

cable housing for covering the drive cable.

12. A remote powered extendable sander in accordance with claim 1 wherein the tool belt attachment device comprises:

a collar latch for holding the drive unit to the tool belt attachment device;

a tab member extending up from the collar latch wherein the tab member at least one belt slot for securing the tool belt attachment device to a tool belt;

a strap member coupled to a bottom section of the collar latch, wherein the strap member is used as a trigger lock to hold a switch of the drive unit in an ON position; and an attachment device coupled to each end of the strap member to secure both ends of the strap member together.

13. A remote powered extendable sander comprising:

a sanding unit having a sanding surface;

a drive system coupled to the sanding unit, the drive system used to move the sanding surface;

a drive transfer unit for transferring rotational motion from a small motorized construction tool to the drive system for powering the sanding unit;

a housing coupled to the sanding unit;

an extension member removably coupled to the housing for raising the remote powered extendable sanders an attachment device for coupling the drive unit away from the sanding unit and to the individual using the remote powered extendable sander.

14. A remote powered extendable sander in accordance with claim 13 wherein the drive transfer unit is coupled to a portable drill.

15. A remote powered extendable sander in accordance with claim 13 wherein the sanding unit comprises:

a belt plate;

a pair of rollers wherein a first roller is placed on a front side and a second roller is placed on a rear side of the belt plate; and a sandpaper belt placed around the pair of rollers and a bottom surface of the belt plate so the bottom surface of the belt plate forms a sanding surface for the sanding unit.

16. A remote powered extendable sander in accordance with claim 15 wherein the drive system comprises:

a first gear coupled to the first roller;

a second gear rotationally coupled to the housing and coupled to the first gear via a drive belt; and a third gear rotationally coupled to the housing and directly coupled to the second gear for rotating the second gear, the third gear having a drive socket formed in a top surface thereof for coupling the third gear to the drive transfer unit.

17. A remote powered extendable sander in accordance with claim 15 wherein the drive system comprises:

a first gear rotationally coupled to the housing and coupled to the first roller via a drive belt; and a second gear rotationally coupled to the housing and directly coupled to the first gear, the second gear having a drive socket formed in a top surface thereof for coupling the second gear to the drive transfer unit.

18. A remote powered extendable sander in accordance with claim 13 further comprising a vacuum socket coupled to a vacuum opening formed in the housing for coupling a vacuum hose to the remote powered extendable sander.

* * * * *